United States Patent [19]

Powell

[11] Patent Number: 4,462,386

[45] Date of Patent: Jul. 31, 1984

[54] HYDRAULIC FRICTION HEATER

[76] Inventor: Louis D. Powell, 3312 Melanie Dr., Des Moines, Iowa 50322

[21] Appl. No.: 505,389

[22] Filed: Jun. 17, 1983

[51] Int. Cl.[3] ..... F24C 9/00

[52] U.S. Cl. ..... 126/247; 122/26; 237/12.1

[58] Field of Search ..... 126/247; 122/26; 237/12, 1 R, 50, 1 SL, 12.3 R, 12.3 A, 12.1; 60/641.1, 398; 165/86, 108; 417/321, 366, 367, 368

[56] References Cited

U.S. PATENT DOCUMENTS

| | | |
|---|---|---|
| 86,270 | 1/1869 | Ball . |
| 187,242 | 2/1877 | Wells . |
| 737,926 | 9/1903 | Hayden et al. . |
| 1,682,102 | 8/1928 | Allen . |
| 2,090,873 | 8/1937 | Lazarus . |
| 2,107,933 | 2/1938 | Crockett et al. . |
| 2,451,873 | 10/1948 | Roebuck . |
| 2,520,729 | 8/1950 | Kollsman . |
| 2,625,929 | 1/1953 | Love et al. . |
| 2,748,762 | 6/1956 | Booth . |
| 2,991,764 | 7/1961 | French . |
| 3,075,514 | 1/1963 | Paugh . |
| 3,164,147 | 1/1965 | Love et al. . |
| 3,198,191 | 8/1965 | Wyszomirski . |
| 3,333,771 | 8/1967 | Graham . |
| 3,402,702 | 9/1968 | Love . |
| 3,748,057 | 7/1973 | Eskeli . |
| 3,791,167 | 2/1974 | Eskeli . |
| 3,937,034 | 2/1976 | Eskeli . |
| 3,972,194 | 8/1976 | Eskeli . |
| 4,004,553 | 1/1977 | Stenstrom . |
| 4,143,639 | 3/1979 | Frenette . |
| 4,253,427 | 3/1981 | Weinert . |
| 4,256,085 | 3/1981 | Line . |
| 4,271,790 | 6/1981 | Ahmed et al. . |
| 4,273,075 | 6/1981 | Freihage . |
| 4,277,020 | 7/1981 | Grenier . |
| 4,285,329 | 8/1981 | Moline . |
| 4,291,756 | 9/1981 | Bracht . |
| 4,295,461 | 10/1981 | Cummings et al. . |
| 4,357,931 | 11/1982 | Wolpert et al. . |
| 4,365,614 | 12/1982 | Grover ..... 126/247 |
| 4,407,449 | 10/1983 | Moser et al. ..... 126/247 X |
| 4,412,651 | 11/1983 | Webster, Jr. ..... 126/247 X |

*Primary Examiner*—Randall L. Green

*Attorney, Agent, or Firm*—Henderson & Sturm

[57] ABSTRACT

A hydraulic friction heating device for providing thermostatically controlled heat to areas requiring heat for comfort or safety. The hydraulic friction heater includes a motor driven positive displacement pump which circulates hydraulic fluid, such as a heat transfer oil, through a tubular coil at a predetermined pressure or temperature. The frictional resistance of the hydraulic fluid traveling through the coil generates usable heat. A blower is disposed to force ambient air into contact with the motor, pump, and tubular coil, and transfers the heat energy to an area to be heated.

10 Claims, 4 Drawing Figures

HYDRAULIC FRICTION HEATER

BACKGROUND OF THE INVENTION

The present invention relates generally to heating devices for providing thermostatically controlled heat to desired areas, and more particularly to friction heaters or furnaces using hydraulic fluid to generate usable friction heat.

Friction heaters presently available have several disadvantages including highly complex structures requiring that extremely close manufacturing tolerances be met in order to obtain a functional heating unit. Further, the complex structures and close operating tolerances result in high maintenance costs and a great deal of down time. Those concerned with these and other problems recognize the need for an improved friction heater.

SUMMARY OF THE INVENTION

The present invention discloses an improved hydraulic friction heater or furnace for providing thermostatically controlled heat to areas such as a dwelling or a similar structure. One embodiment of the friction heater includes a motor driven pump which circulates a hydraulic fluid through a tubular coil at a predetermined pressure. The pressure is controlled by a hydraulic fluid reservoir which feeds the suction side of the pump, and a by-pass line which includes a pressure activated valve disposed to open when the pressure exceeds a predetermined level.

An alternate embodiment of the friction heater includes a low temperature by-pass line having a temperature activated valve disposed to close when the temperature of the hydraulic fluid in the coil rises to a predetermined level. Also, an auxiliary by-pass line is provided to level the load on the pump motor.

The frictional resistance of the hydraulic fluid forced through the coil under pressure generates usable heat. The frictional heat is transferred by conduction to the walls of the tubular coil and to the hydraulic fluid. Also, heat is generated by operation of the motor and the pump. A blower is provided to intake ambient air and force the air into contact with the heated coil, the reservoir which contains a quantity of heated hydraulic fluid, the motor and the pump. Heat radiated by all of these components is then carried by air convection through a plurality of heat runs which supply heated air to specific locations.

The pump motor and blower are activated and deactivated by conventional thermostatic controls.

An object of the present invention is the provision of an improved friction heater.

Another object is to provide a friction heater having an uncomplicated structure that is easy to manufacture and maintain.

A further object of the invention is the provision of a heater which is safe since it is explosion proof, it does not employ red hot electrical elements, and it does not employ combustion. Since there are no flames or waste gases, no chimney or flue is required.

Still another object is to provide a friction heater which is efficient and economical to operate.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
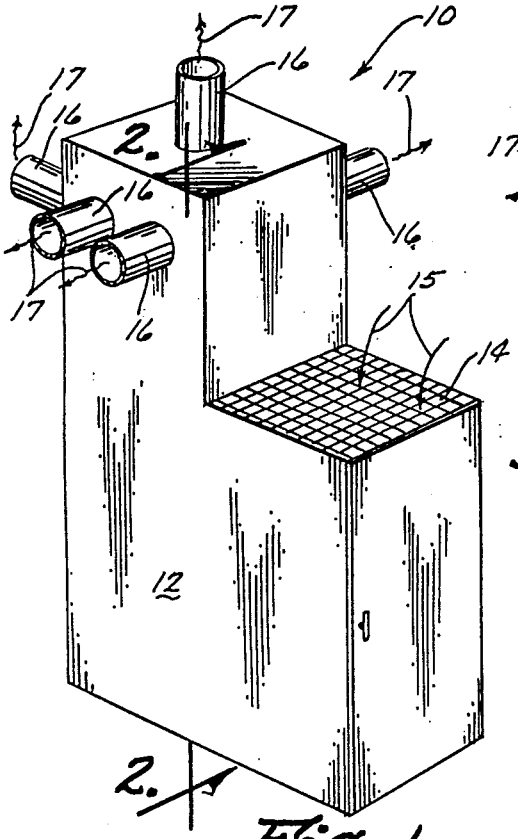
FIG. 1 is a perspective view of the hydraulic friction heater of the present invention, showing the exterior housing wherein ambient air enters through the cold air return and heated air is forced out through a plurality of heat runs.

Referring now to the drawings wherein like reference numerals designate identical or corresponding parts throughout the several views, FIG. 1 shows the hydraulic friction heater of this invention generally designated by the reference numeral 10. The friction heater 10 is enclosed by an insulated housing 12 which includes an ambient air intake 14 and a plurality of heat runs 16. The flow of ambient air into the air intake 14 is indicated by directional arrows 15, and the flow of heated air through the heat runs 16 is indicated by directional arrows 17.

Figure 2:
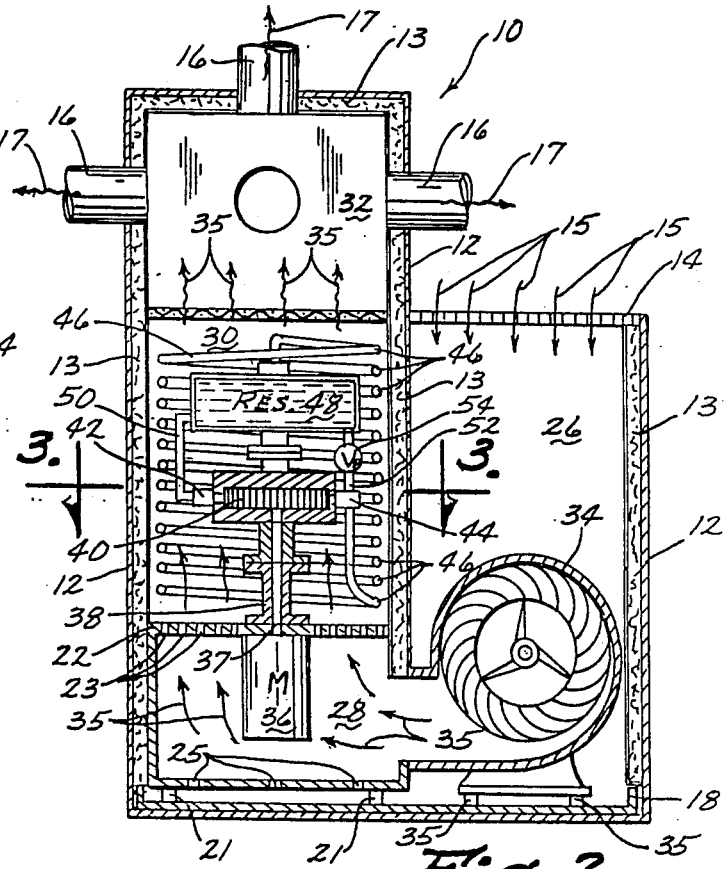
FIG. 2 is a sectional side elevational view, taken along line 2—2 of FIG. 1, showing a first embodiment using a pressure activated by-pass system.

As shown in FIG. 2, the sidewalls of housing 12 are lined with insulation 13 and a catch pan 18 is disposed to rest on the base of housing 12. A support frame 20 is elevated above the catch pan 18 by legs 21. The support frame 20 includes an upper horizontally disposed air pervious plate 22 having openings 23 and a lower horizontally disposed plate 24 having openings 25 to allow the flow of hydraulic fluid to catch pan 18 in the event of leakage from the system.

The housing 12 is divided into four compartments, including the ambient air intake chamber 26, the pump motor chamber 28, the heat chamber 30, and the heated air plenum chamber 32.

A blower 34 is disposed within ambient air intake chamber 26 and supported above the catch pan 18 by legs 35. The blower 34 forces ambient air into pump motor chamber 28 as indicated by directional arrows 35. The pump motor 36 is mounted on the underside of air pervious plate 22 and is suspended above plate 24. The drive shaft 37 of motor 36 extends through and is aligned by pump mounting bracket 38. A gear pump 40 is mounted on pump mounting bracket 38 and is driven by motor 36. The bottom of heat chamber 30 is defined by the air pervious plate 22 and the top heat chamber 30 is defined by air filter element 31.

Pump 40 includes a suction port 42 and a discharge port 44. A coiled tubing 46 has one end attached to the discharge port 44 and a second end attached to a hydraulic fluid reservoir 48. The reservoir 48 is connected by line 50 which in turn feeds a supply of hydraulic fluid to the suction port 42. This hydraulic fluid is circulated through the coiled tubing 46 by a pump 40.

Referring now to FIG. 2, a first embodiment is disclosed wherein a by-pass line 52 interconnects the discharge port 44 and the reservoir 48. A pressure activated control valve 54 is disposed in the by-pass line 52 and is biased in a closed position. Pressure valve 54 is disposed to move to an open position when the pressure exerted by the pump 40 exceeds a predetermined level. Thus, the pressure of the hydraulic fluid in coil 46 is maintained at the desired level.

Figure 4:
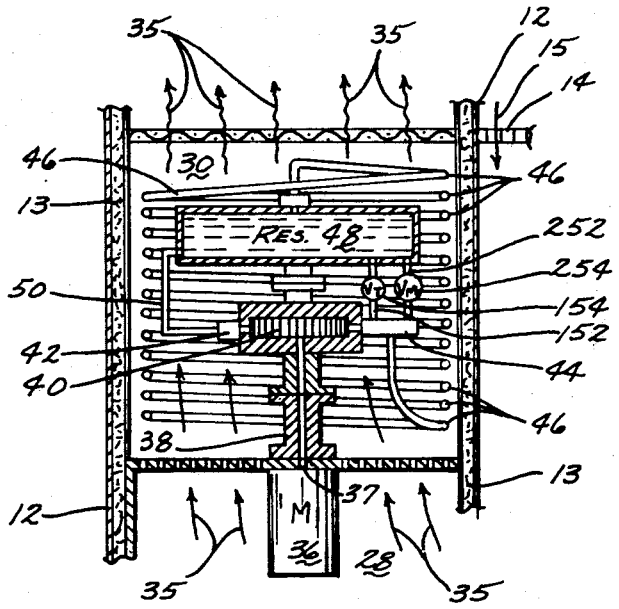
FIG. 4 is a partial sectional side elevational view showing a second embodiment wherein both a temperature activated by-pass system and an auxiliary by-pass system are employed.

FIG. 4 illustrates a second embodiment of the present invention wherein a dual by-pass system is shown. A temperature activated control valve 154 controls the flow of hydraulic fluid through by-pass line 152. When temperature sensors (not shown) disposed in the coil 46 sense the temperature of the hydraulic fluid is excess of a predetermined temperature, the temperature activated control valve 154 is closed thus directing a larger volume of hydraulic fluid through the coil 46. Also shown in Fig. 4, an auxiliary by-pass line 252 is controlled by motor load valve 254. The opening of motor load valve 254 may be preset manually to level the load or pump motor 36 during start-up, or motor load valve 254 may be activated by load sensors (not shown) such that when the motor 36 is under high load the motor load valve 254 would open to allow flow through by-pass line 252 thereby reducing the load.

It is to be understood that by-pass structures similar to those shown in FIGS. 2 and 4 could directly interconnect the discharge port 44 and suction port 42, or could be provided within the casing of pump 40 itself.

Figure 3:
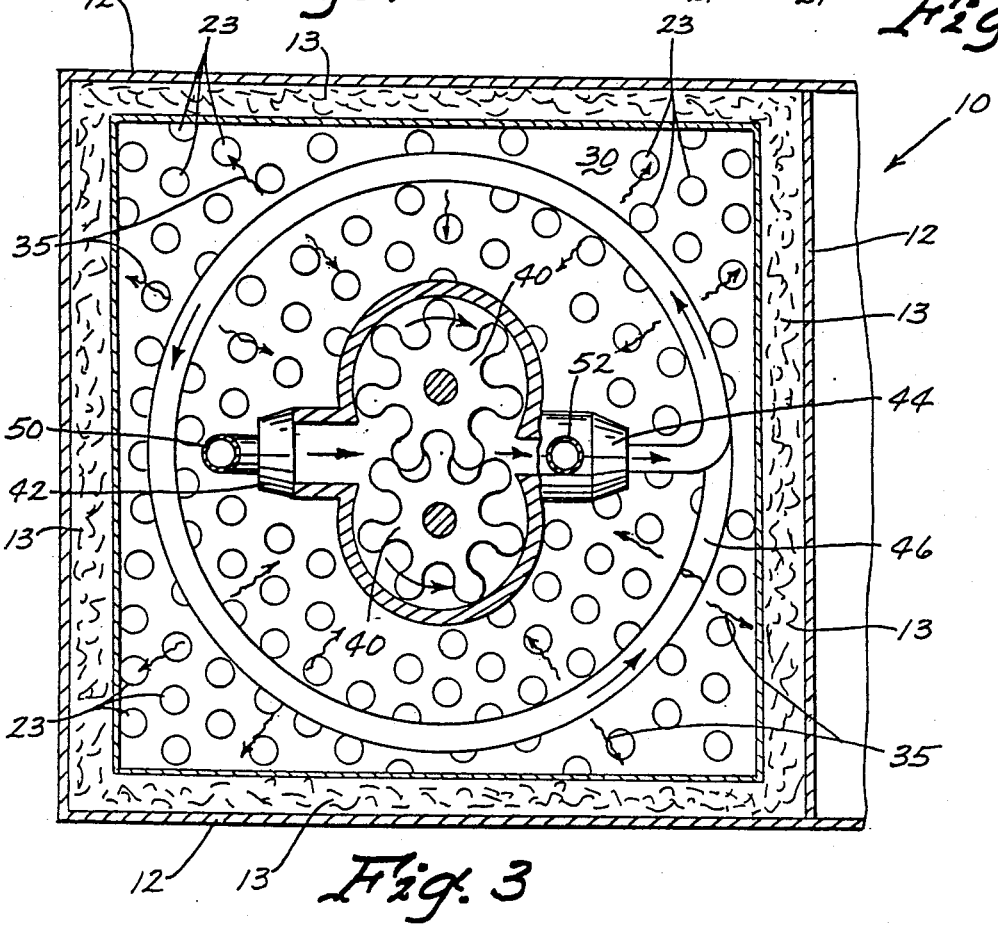
FIG. 3 is a sectional top plan view, taken along line 3—3 of FIG. 1.

FIG. 3 illustrates a square cross-section of the heat chamber 30. It is to be understood that the cross-section could also be circular or of another configuration.

In operation, a conventional thermostatic control is set and activates the pump motor 36 when the temperature in the environment of the control falls to a predetermined level. The pump 40 circulates hydraulic fluid, such as heat transfer oil, through coil 46 and the frictional resistance of the fluid traveling through the coil 46 generates heat. When the temperature in the heat chamber 30 reaches a predetermined level, a heat sensitive disc switch (not shown) activates the blower 34. The blower 34 forces ambient air to contact the motor 36, the pump 40, the coil 46, and the reservoir 48 and transfers heat radiated therefrom by convection into the heated air plenum 40 and forces air through heat runs 16 to specific locations.

When the temperature setting of the thermostatic control is reached, the pump motor 36 is deactivated and the blower 34 continues to operate for a predetermined time, at which point the blower 34 is deactivated.

When the thermostatic control restarts the pump motor 36, the hydraulic fluid is preheated since the supply of hydraulic fluid in the reservoir 48 tends to retain its heat energy.

The following specific examples of friction heaters are given for purposes of illustration only and it is to be understood that the invention is not limited to the specific examples given.

EXAMPLE 1

Two gallons of hydraulic fluid, D-X heat transfer oil #25, was charged to the reservoir 48. A gear pump 40, having a capacity of 18 gallons per minute was powered by a 3 horsepower, 240 volt, 1800 rpm, single phase electric motor. A 145–200 foot coil of metal tubing having an outside diameter of 0.625 inches and an inside diameter of 0.555 inches was connected between the discharge port 44 and the reservoir 48. The pressure activated control valve 54 was set to open, and therefore cause the hydraulic fluid to flow through by-pass line 52, when the pressure of the hydraulic fluid in the coil 46 exceeded 250–340 pounds per square inch.

EXAMPLE 2

The reservoir 48 was charged with 2.5 gallons of D-X heat transfer oil #25. A gear pump 40, having a capacity of 1227 gallons per minute was powered by a 5 horsepower, 240 volt, 1800 rpm, single phase electric motor. A 145–200 foot coil of metal tubing having an outside diameter of 0.750 inches and an inside diameter of 0.715 inches was connected between the discharge port 44 and the reservoir 48. The pressure activated control valve 54 was set to open, and therefore cause the hydraulic fluid to flow through by-pass line 52, when the pressure of the hydraulic fluid in the coil 46 exceeded 250–340 pounds per square inch.

Thus, it can be seen that at best all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A hydraulic friction heater comprising:

a frame;

a heat chamber supported by said frame;

a pump mounted on said frame, said pump including a suction port and a discharge port;

means for driving said pump;

tubing disposed within said heat chamber and having one end disposed in fluid communication with said discharge port and a second end disposed in fluid communication with said suction port, whereby hydraulic fluid is circulated through said tubing by said pump and the frictional resistance of said hydraulic fluid circulating through said tubing generates usable heat energy;

a hydraulic fluid reservoir disposed in fluid communication between said second end of said tubing and said suction port; and a by-pass line disposed in fluid communication between said discharge port and said hydraulic fluid reservoir, said by-pass line including a temperature actuated control valve, said valve being biased in an open position and disposed to move to a closed position when the temperature of said hydraulic fluid exceeds a predetermined level to increase the flow through said tubing.

2. The hydraulic friction heater of claim 1 further comprising:

means for forcing ambient air through said heat chamber.

3. The hydraulic friction heater of claim 2 wherein said frame includes an air pervious plate forming the bottom of said heat chamber and said pump is mounted on said plate within said heat chamber.

4. The hydraulic friction heater of claim 3 wherein said pump driving means is an electric motor mounted on said air pervious plate.

5. The hydraulic friction heater of claim 4 further comprising:

a by-pass line disposed in fluid communication between said discharge port and said hydraulic fluid reservoir, said by-pass line including an electric motor load actuated control valve, said valve being biased in a closed position and disposed to move to an open position when the load on said motor exceeds a predetermined level.

6. The hydraulic friction heater of claim 1 wherein said tubing forms a coil.

7. The hydraulic friction heater of claim 1 wherein said pump is a positive displacement pump.

8. The hydraulic friction heater of claim 7 wherein said positive displacement pump is a gear pump.

9. A hydraulic friction heater comprising:

a frame including an air pervious plate;

a heat chamber supported by said frame wherein said air pervious plate forms the bottom of said heat chamber;

a pump mounted on said air pervious plate within said heat chamber, said pump including a suction port and a discharge port;

means for driving said pump, said pump driving means being mounted on said air pervious plate;

a coiled tubing disposed within said heat chamber and having one end disposed in fluid communication with said discharge port and a second end disposed in fluid communication with said suction port;

a hydraulic fluid reservoir disposed within said heat chamber and disposed in fluid communication between said second end of said tubing and said suction port;

a by-pass line disposed in fluid communication between said discharge port and said hydraulic fluid reservoir, said by-pass line including a valve, said valve being disposed to control the flow of hydraulic fluid through said by-pass line; wherein said valve in said by-pass line is temperature actuated and biased in an open position and disposed to move to a closed position when the temperature of said hydraulic fluid exceeds a predetermined level to increase the flow through said coiled tubing; and means for forcing ambient air through said air pervious plate and through said heat chamber, whereby the air contacts the pump driving means, the pump, the reservoir, and the coiled tubing, and transfers the heat energy therefrom to an area to be heated.

10. The hydraulic friction heater of claim 9 wherein said pump driving means is an electric motor, and wherein said valve in said by-pass line is electric motor load actuated and biased in a closed position and disposed to move to an open position when the load on said motor exceeds a predetermined level.

* * * * *